US009677328B2

(12) United States Patent
Hsu et al.

(10) Patent No.: US 9,677,328 B2
(45) Date of Patent: Jun. 13, 2017

(54) CORDLESS CURTAIN ASSEMBLY WITH MAGNETIC UNITS

(71) Applicant: CHING FENG HOME FASHIONS CO., LTD, Fuxing Shiang, Changhua County (TW)

(72) Inventors: Sheng-Ying Hsu, Changhua County (TW); Chun Jan Hsu, Changhua County (TW)

(73) Assignee: CHING FENG HOME FASHIONS CO., LTD., Fuxing Shiang (TW)

( * ) Notice: Subject to any disclaimer, the term of this patent is extended or adjusted under 35 U.S.C. 154(b) by 0 days.

(21) Appl. No.: 15/237,633

(22) Filed: Aug. 16, 2016

(65) Prior Publication Data

US 2017/0138121 A1 May 18, 2017

(30) Foreign Application Priority Data

Nov. 12, 2015 (TW) ..... 104218132 U

(51) Int. Cl.
*E06B 9/262* (2006.01)
*H01F 7/02* (2006.01)

(52) U.S. Cl.
CPC ..... *E06B 9/262* (2013.01); *E06B 2009/2622* (2013.01); *H01F 7/0252* (2013.01)

(58) Field of Classification Search
CPC . E06B 9/262; E06B 2009/2622; H01F 7/0252
USPC ..... 24/303
See application file for complete search history.

(56) References Cited

U.S. PATENT DOCUMENTS 5,196,818 A * 3/1993 Anderson ..... A45F 5/00 223/109 A
6,833,507 B2 * 12/2004 Arkin ..... B60R 11/00 174/135
6,988,526 B2 * 1/2006 Judkins ..... E06B 9/262 160/84.01
7,150,304 B2 12/2006 Hsu
2005/0109468 A1 * 5/2005 Hsu ..... E06B 9/262 160/84.01

(Continued)

FOREIGN PATENT DOCUMENTS

CH 692877 A5 * 11/2002

OTHER PUBLICATIONS

U.S. Appl. No. 15/091,590, filed Apr. 6, 2016.
U.S. Appl. No. 15/091,593, filed Apr. 6, 2016.

*Primary Examiner* — Blair M Johnson

(57) ABSTRACT

A cordless curtain assembly includes a fabric connected to a top rail. The fabric has multiple transverse folding sections and each folding section has a passage defined therein. Multiple magnetic units are respectively received in the passages of the folding sections and each have a carrier, multiple clamping members and multiple magnetic parts. The carrier of each magnetic unit has two reception areas defined in the top thereof. Each clamping member has a press bar and two legs which respectively extend from the underside of the press bar. Each leg has a resilient arm extending outward therefrom. Each clamping member has one of the magnetic parts clamped between the two legs. The combination of the clamping member and the magnetic part are securely inserted into the reception area corresponding thereto. The press bar seals the top opening of the reception area.

5 Claims, 8 Drawing Sheets

(56) References Cited

U.S. PATENT DOCUMENTS

| | | | | |
|---|---|---|---|---|
| 2012/0234502 | A1* | 9/2012 | Chen | E06B 9/262 160/84.01 |
| 2015/0146371 | A1* | 5/2015 | Liang | G06F 1/1656 361/679.56 |
| 2016/0120352 | A1* | 5/2016 | Hsu | E06B 9/262 160/201 |
| 2016/0235237 | A1* | 8/2016 | Chu | E06B 9/262 |
| 2016/0376837 | A1* | 12/2016 | Hsu | E06B 9/262 160/84.01 |
| 2016/0376838 | A1* | 12/2016 | Hsu | E06B 9/28 160/84.03 |

* cited by examiner

CORDLESS CURTAIN ASSEMBLY WITH MAGNETIC UNITS

BACKGROUND OF THE INVENTION

1. Fields of the Invention

The present invention relates to a cordless curtain assembly, and more particularly, to a cordless curtain assembly having magnetic units connected to the fabric of the curtain so as to fold the fabric of the curtain by attracting the magnetic units.

2. Descriptions of Related Art

The conventional curtain assemblies generally have operation cords which hang downward from the top rail of the curtain assembly, and the users can pull the operation cords to collect or to expand the fabric of the curtain assembly. However, the operation cords have potential risks to children if the operation cords wrap around the children's neck.

Cordless curtain assembles are developed to improve the above mentioned problem. One of the conventional cordless curtain assemblies is disclosed in applicant's former U.S. Pat. No. 7,150,304 which discloses multiple magnets connected to the fabric so that when the curtain is folded, the user folds the bottom end of the fabric upward to attract the magnets consecutively. When expanding the fabric, the user pulls the bottom end of the fabric to detach the magnets one by one. No cord needed.

However, the magnets have to be connected to the fabric one by one by either melting art or sewing art. This takes a lot of time and the magnets may shift by impact. Besides, when installing the magnetic parts, the negative pole and the positive pole of each of the magnetic parts have to be correctly orientated so as to fold the fabric by attracting the magnetic parts correctly. This also increases assembling time and reduces the production efficiency of the cordless curtain assemblies.

The present invention intends to provide a cordless curtain with a magnetic operation system to eliminate the shortcomings mentioned above.

SUMMARY OF THE INVENTION

The present invention relates to a cordless curtain assembly and comprises top rail and a fabric is connected to the top rail. The fabric has multiple folding sections formed transversely thereto and each folding section has a passage defined therein. Multiple magnetic units are respectively received in the passages of the folding sections. Each magnetic unit has a carrier, multiple clamping members and multiple magnetic parts. The carrier of each magnetic unit is received in the passage corresponding thereto and has a first sidewall and a second sidewall which is located opposite to the first sidewall. A hollow area is defined between the first and second sidewalls. Two reception areas are defined in the top of the carrier and communicating with the hollow area. Each clamping member has a press bar and two legs which respectively extend from the underside of the press bar. The press bar has an identification portion. A receiving space is defined between the two legs and the press bar. Each leg has a resilient arm extending outward from the outside thereof and toward the press bar. Each resilient arm has a distal end. A gap is defined between each of the legs and the resilient arm corresponding thereto. Each clamping member has one of the magnetic parts clamped in the receiving space thereof. Each of the magnetic parts has a positive-pole face and a negative-pole face which is located opposite to the positive-pole face. The clamping members are respectively engaged with the reception areas. The two legs are inserted into the reception area and the press bar seals the top opening of the reception area. The resilient arms of each clamping members are squeezed when passing through the reception area. When the clamping member is engaged with the reception area, the resilient arms expand outward to restrict the clamping member from dropping out from the reception area of the carrier. The fabric is folded by attracting the magnetic units in the folding sections one by one.

Preferably, the carriers each are an elongate plastic part, and the upright height of the first sidewall is smaller than that of the second sidewall.

Preferably, each of the clamping members is a U-shaped plastic member. The width of each of the legs is smaller than the width of the underside of the press bar so as to form two elongate areas formed on two sides of the underside of the press bar relative to the two legs. Each of the reception areas has a recessed portion defined in each of the first and second sidewalls of the carrier. A first top support face is defined on the first sidewall by the recessed portion corresponding thereto, and a second top support face is defined on the second sidewall by the recessed portion corresponding thereto. The two legs and the two resilient arms are inserted into the reception area between the first and second sidewalls. The two elongate areas of the press bar are rested on the first and second top support faces when the press bar is engaged with the recessed portions of the first and second sidewalls to seal the top opening of the reception area.

Preferably, the width of the gap becomes larger toward the press bar.

Preferably, each of the two legs of each of the clamping members has two flanges extending from the inside thereof. A clamping slot is formed between the flanges of the two legs. The magnetic part is fitted into the clamping slot and restricted by the flanges.

The primary object of the present invention is to provide a cordless curtain assembly using magnetic units, wherein each magnetic unit includes a carrier which accepts multiple combinations of clamping members and magnetic parts. The clamping members are securely engaged with the reception areas of the carrier so that the assembly is easy and efficiency.

Another object of the present invention is to provide a cordless curtain assembly using magnetic units, wherein each clamping member has an identification portion which guides the assemblers to correctly install the magnetic parts to the clamping members.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
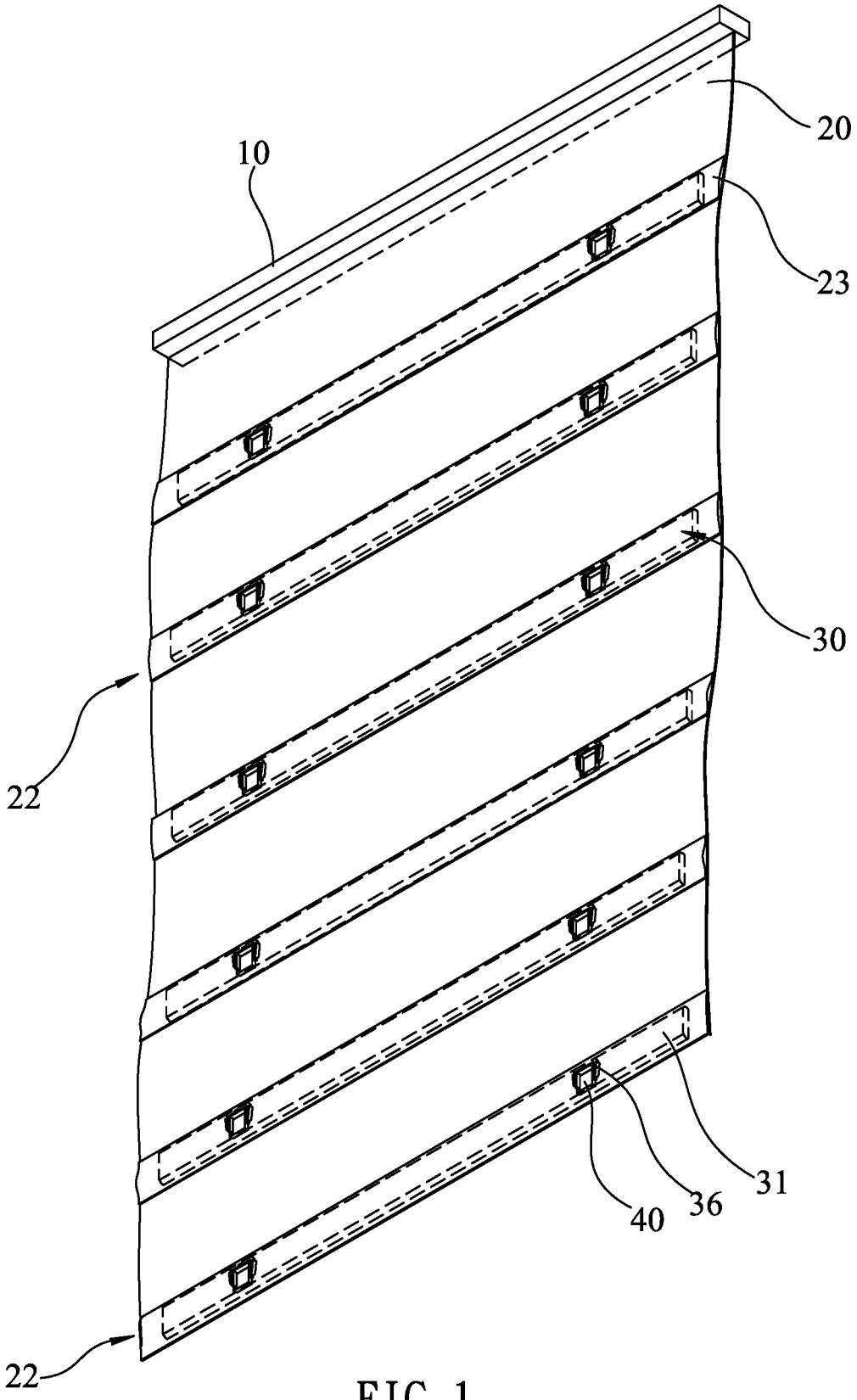
FIG. 1 is a perspective view to show that the cordless curtain assembly of the present invention is expanded.
Figure 2:
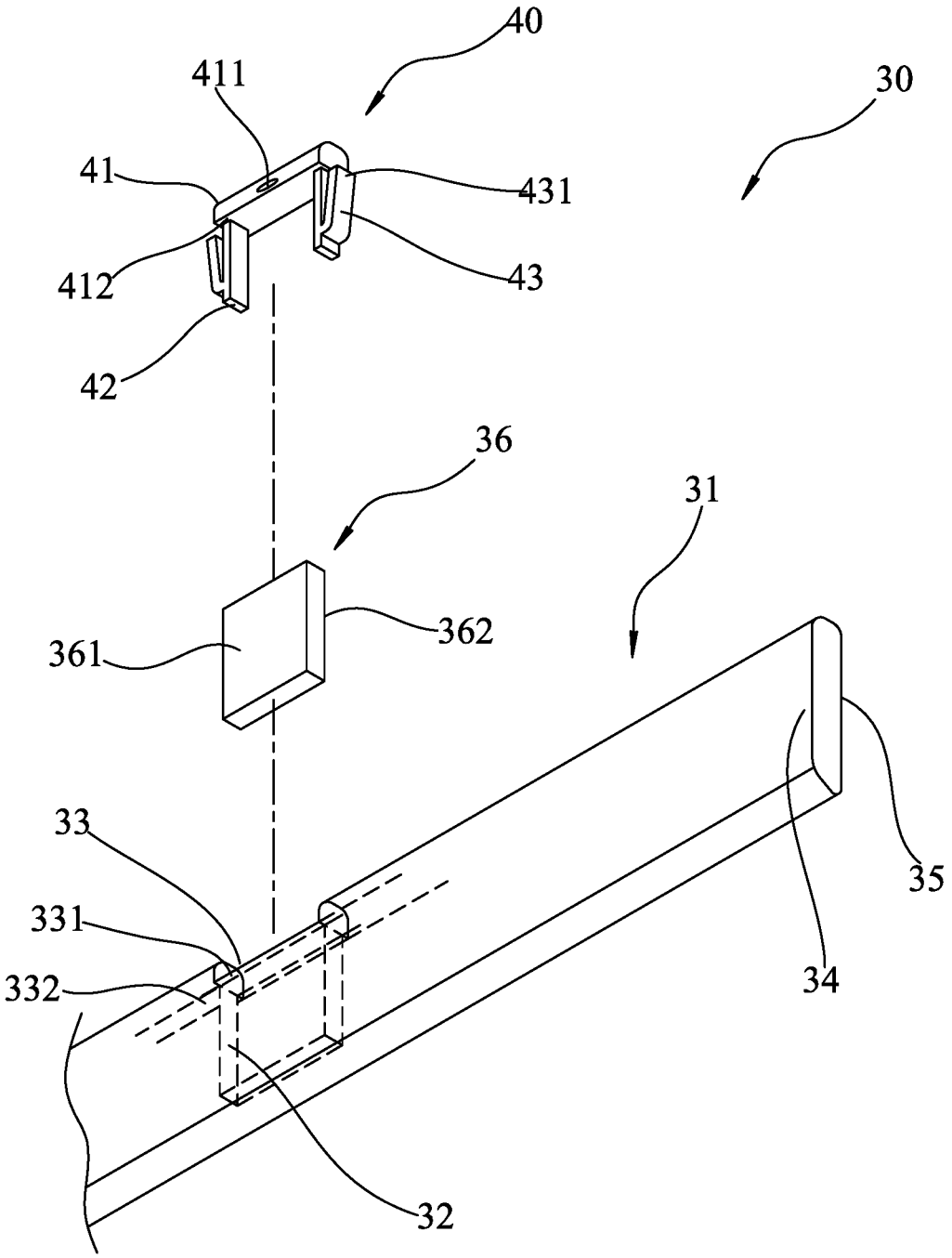
FIG. 2 is an exploded view of the magnetic unit of the cordless curtain assembly of the present invention.
Figure 3:
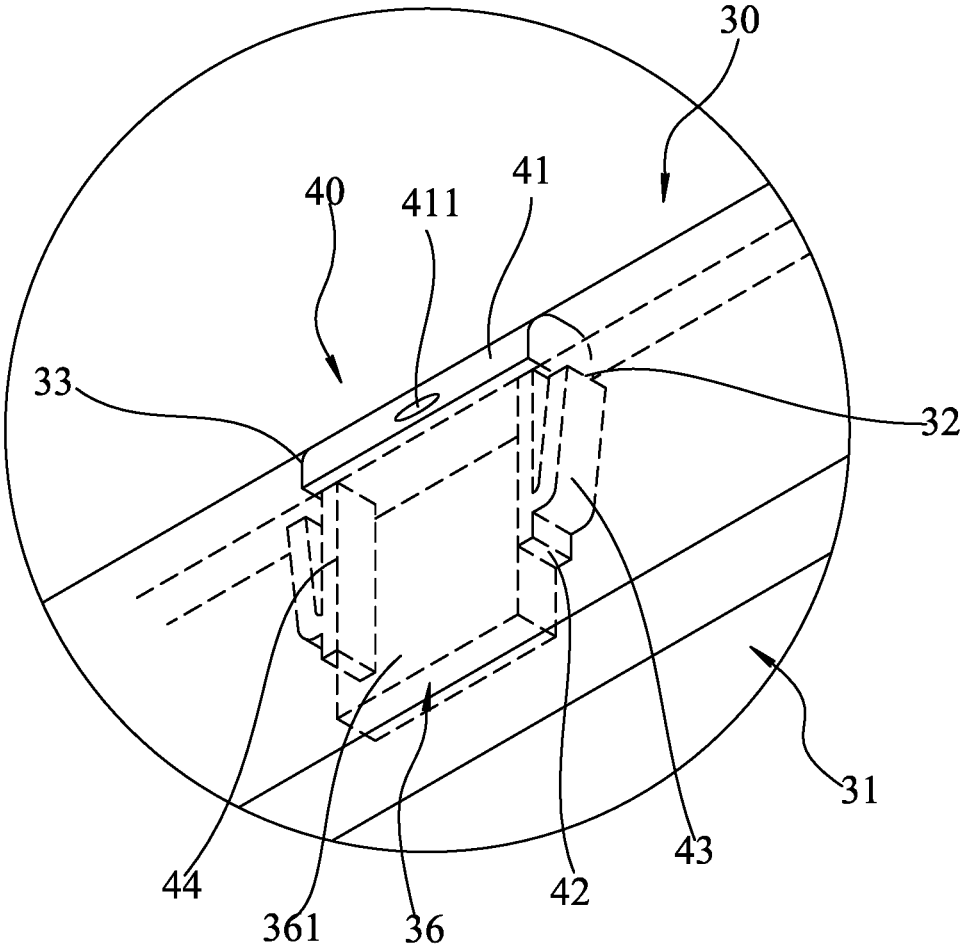
FIG. 3 is an enlarged view to show that the combination of the clamping member and the magnetic part is engaged with the reception area of the carrier of the magnetic unit of the cordless curtain assembly of the present invention.
Figure 4:
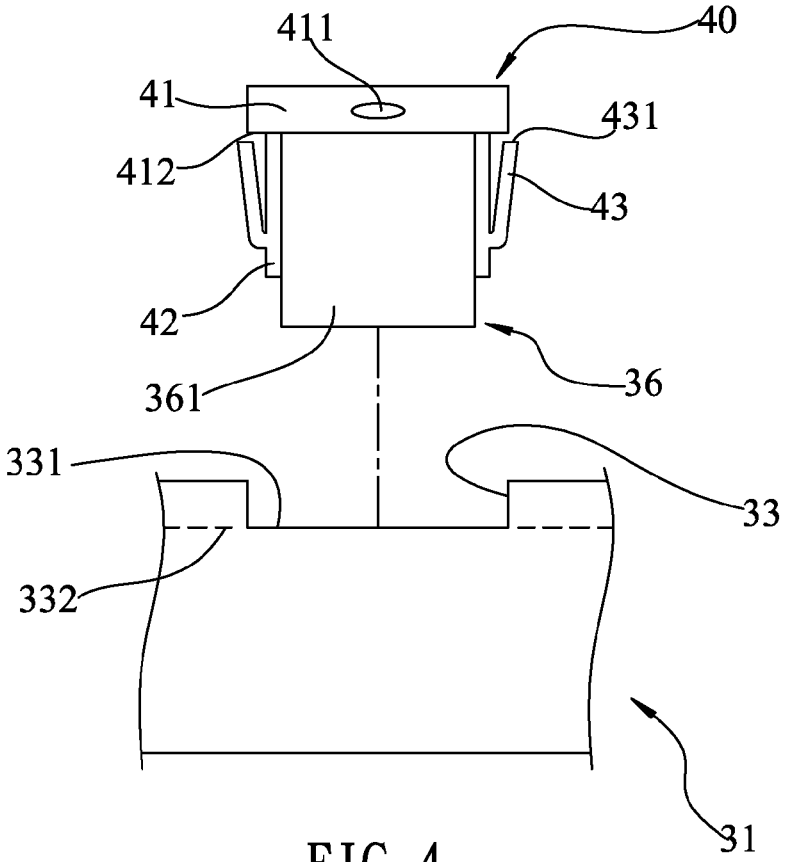
FIG. 4 is a front view to show that the combination of the clamping member and the magnetic part is to be engaged with the reception area of the carrier of the magnetic unit of the cordless curtain assembly of the present invention.
Figure 5:
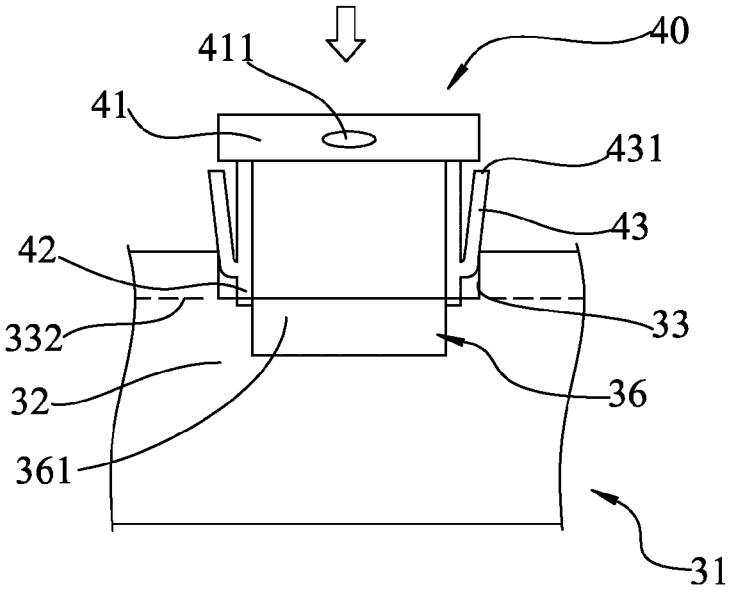
FIG. 5 is a front view to show that the combination of the clamping member and the magnetic part enters into the reception area of the carrier of the magnetic unit of the cordless curtain assembly of the present invention.
Figure 6:
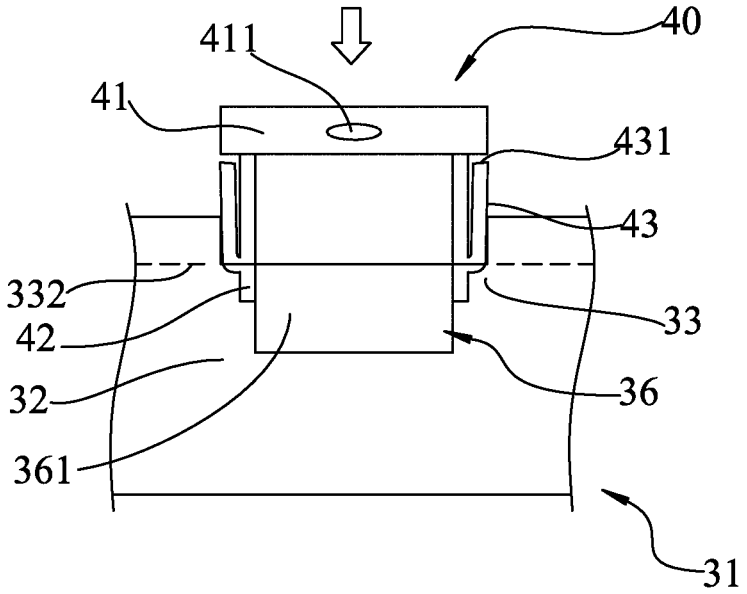
FIG. 6 is a front view to show that the resilient arms of the clamping member are squeezed when entering into the reception area of the carrier of the magnetic unit of the cordless curtain assembly of the present invention.
Figure 7:
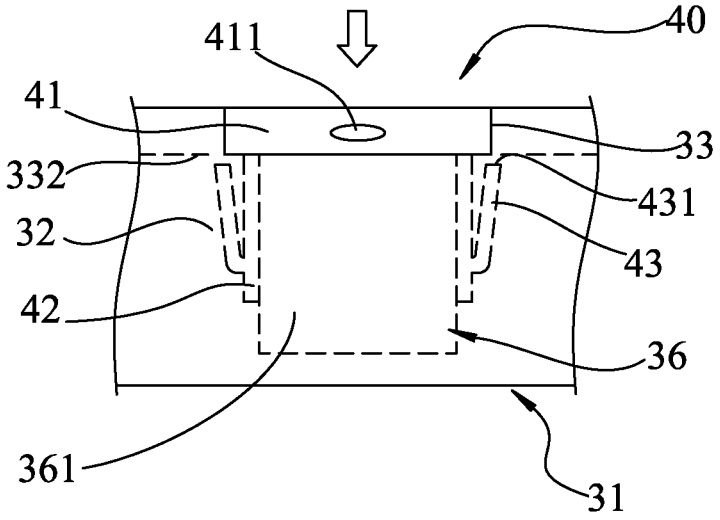
FIG. 7 is a front view to show that the resilient arms of the clamping member expand outward after that the combination of the clamping member and the magnetic part is engaged with the reception area of the carrier of the magnetic unit of the cordless curtain assembly of the present invention.

Referring to FIGS. 1 to 3, the cordless curtain assembly of the present invention comprises a top rail 1 and a fabric 20 having its top end connected to the top rail 1. Multiple folding sections 22 are formed transversely at even distance to the fabric 20, and each folding section 22 includes an elongate decoration piece connected to the fabric 20 so as to define a passage 23 between the decoration piece and the fabric 20.

Multiple magnetic units 30 are respectively received in the passages 23 of the folding sections 22. Each magnetic unit 30 has a carrier 31, multiple clamping members 40 and multiple magnetic parts 36. The carrier 31 of each magnetic unit 30 is received in the passage 23 corresponding thereto and has a first sidewall 34 and a second sidewall 35 which is located opposite to the first sidewall 34. The carriers 31 each are an elongate plastic part. The upright height of the first sidewall 34 is smaller than that of the second sidewall 35. A hollow area 32 is defined between the first and second sidewalls 34, 35. Two reception areas 33 are defined in the top of each of the carriers 31 and communicates with the hollow area 32.

Each clamping member 40 has a press bar 41 and two legs 42 which respectively extend from the underside of the press bar 41. The press bar 41 has an identification portion 411 formed to one side thereof. A receiving space 44 is defined between the two legs 42 and the press bar 41. Each leg 42 has a resilient arm 43 extending outward from the lower portion of the outside thereof and toward the press bar 41. Each resilient arm 43 has a distal end 431. A gap is defined between each of the legs 42 and the resilient arm 43 corresponding thereto. The width of the gap becomes larger toward the press bar 41 so that the resilient arm 43 is allowed to be squeezed toward the leg 42.

Each clamping member 40 has one of the magnetic parts 36 clamped in the receiving space 44 thereof. Each of the magnetic parts 36 has a positive-pole face 361 and a negative-pole face 362 which is located opposite to the positive-pole face 361. When installing the magnetic part 36 in the receiving space 44, the assemblers can easily install the magnetic part 36 by reference of the position of the identification portion 411 on the press bar 41.

As shown in FIGS. 4 to 7, the clamping members 40 are to be respectively engaged with the reception areas 33. The two legs 42 are inserted into the reception area 33 and the press bar 41 seals the top opening of the reception area 33. The resilient arms 43 of each clamping members 40 are squeezed when passing through the reception area 33. When the clamping member 40 is completely engaged with the reception area 33, the resilient arms 43 expand outward to restrict the clamping member 40 from dropping out from the reception area 33 of the carrier 31.

Specifically, each of the clamping members 40 is a U-shaped plastic member. The width of each of the legs 42 is smaller than the width of the underside of the press bar 41 so as to form two elongate areas 412 formed on two sides of the underside of the press bar 41 relative to the two legs 42. Each of the reception areas 33 has a recessed portion defined in each of the first and second sidewalls 34, 35 of the carrier 31. A first top support face 331 is defined on the first sidewall 34 by the recessed portion corresponding thereto, and a second top support face 332 is defined on the second sidewall 35 by the recessed portion corresponding thereto. The two legs 42 and the two resilient arms 43 are inserted into the reception area 33 between the first and second sidewalls 34, 35. The two elongate areas 412 of the press bar 41 are rested on the first and second top support faces 331, 332 when the press bar 41 is engaged with the recessed portions of the first and second sidewalls 34, 35 to seal the top opening of the reception area 33. Preferably, the top surface of the press bar 41 is in flush with the top of the carrier 31.

Figure 8:
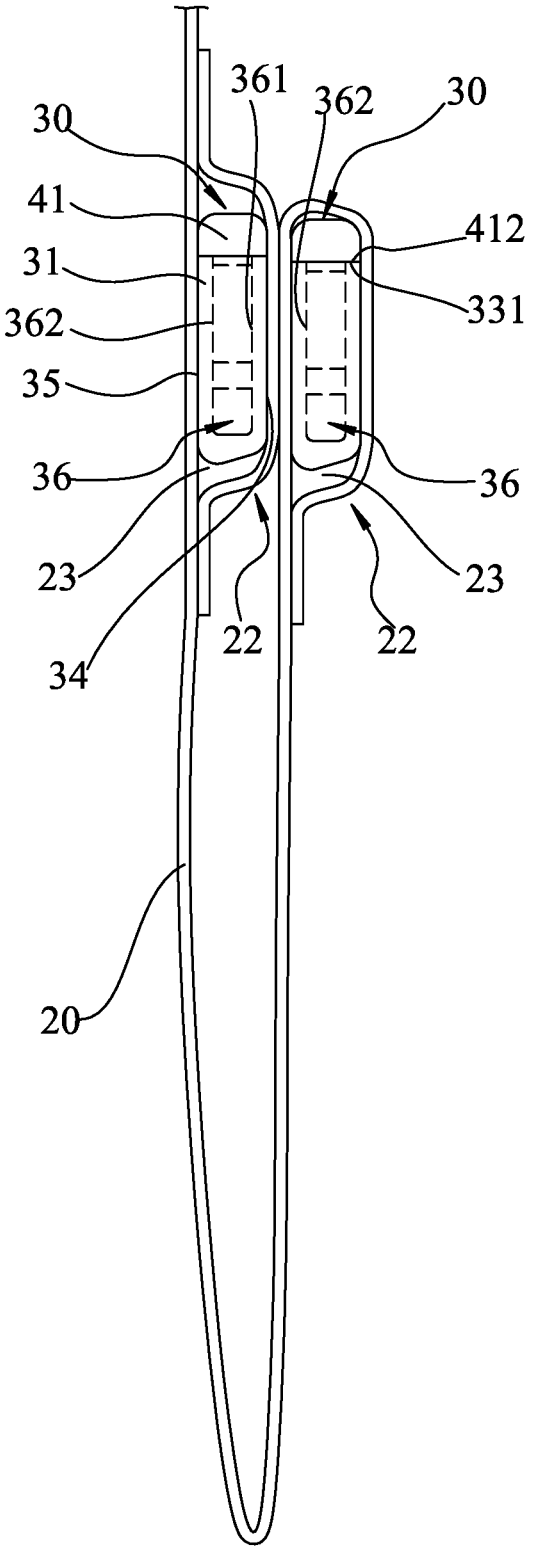
FIG. 8 is an end view to show that the magnetic units in the folding sections of the fabric are attracted to each other when folding the fabric of the cordless curtain assembly of the present invention.

As shown in FIG. 8, when folding the cordless curtain assembly, the lower end of the fabric 20 is folded upward by attracting the magnetic units 30 in the folding sections 22 one by one. The fabric 20 is able to be folded upward to a desired position. When expanding the fabric 20, a force is applied to pull the folded sections of the fabric 20 to separate the attracted magnetic units 30.

Figure 9:
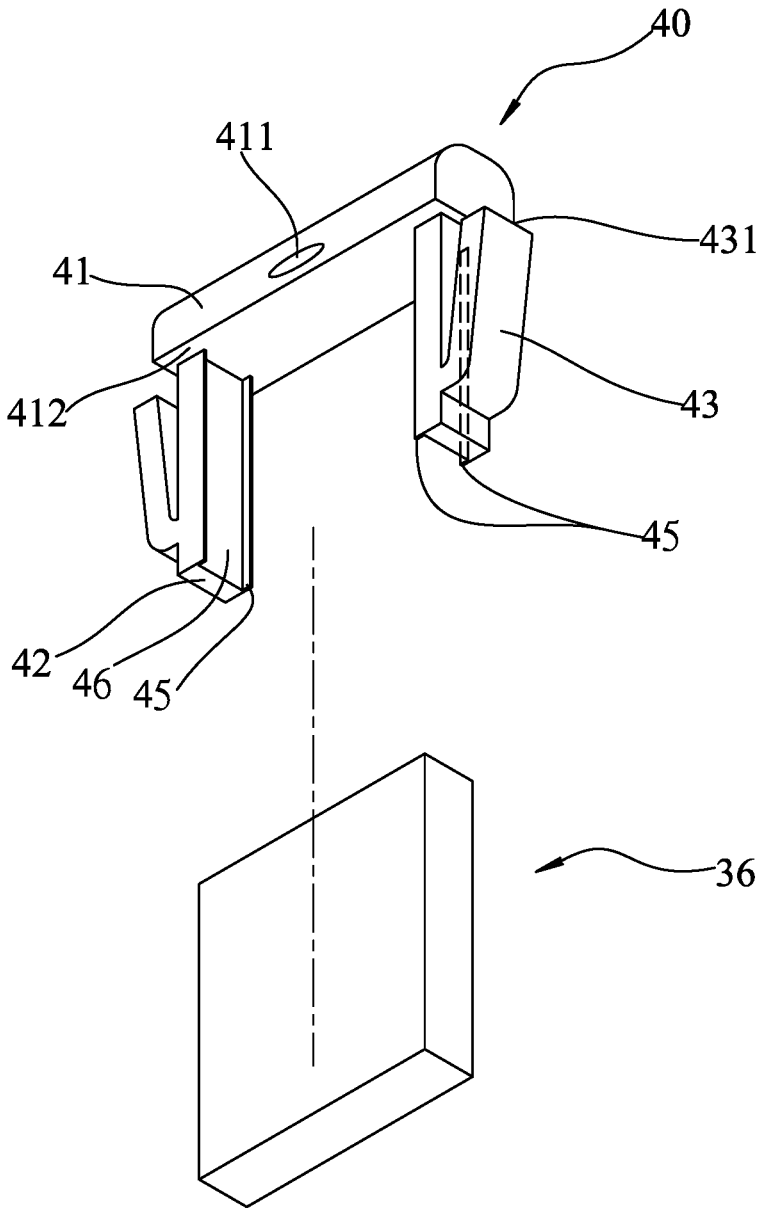
FIG. 9 shows another embodiment of the clamping member of the present invention.
Figure 10:
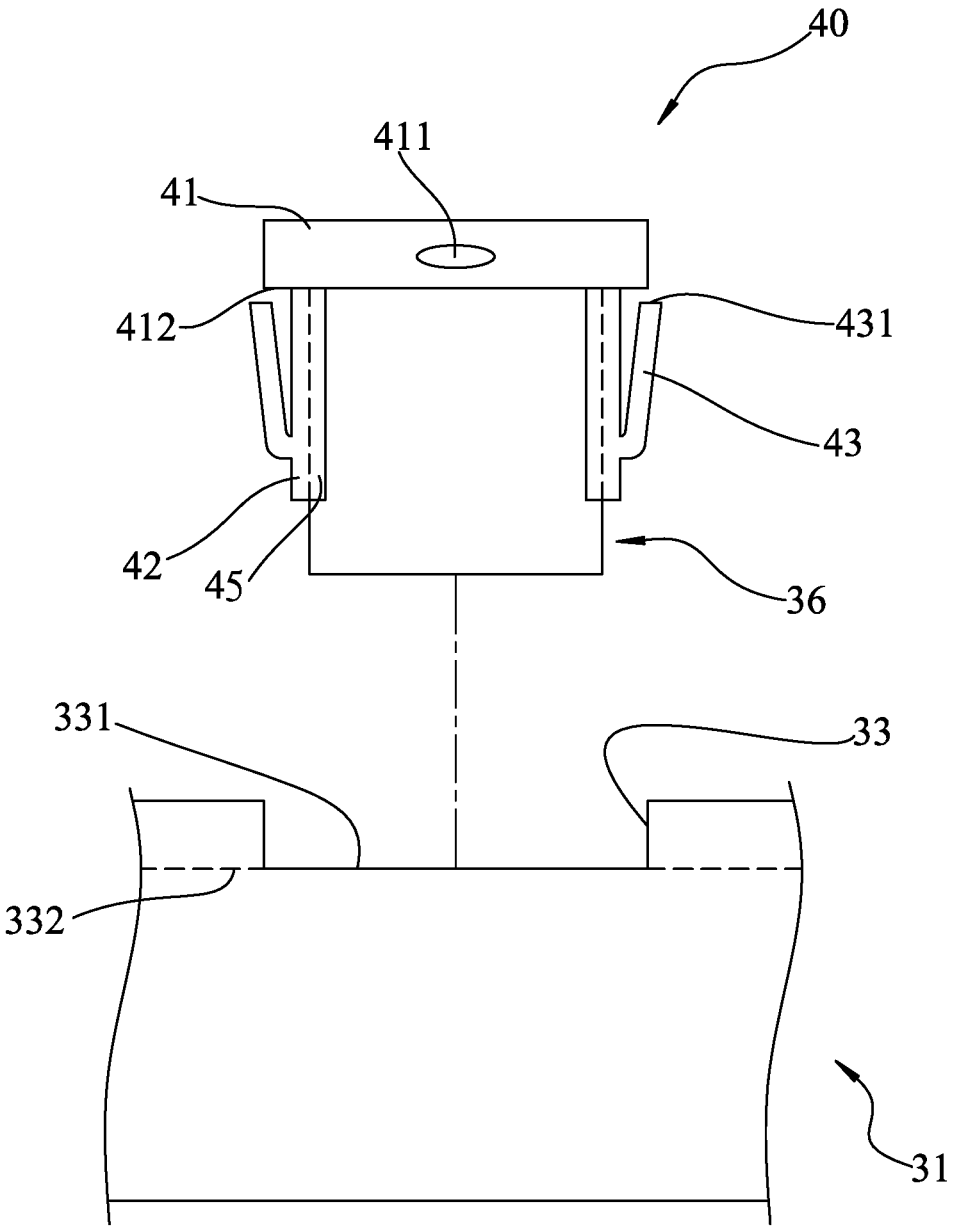
FIG. 10 shows that the magnetic part is clamped between the legs of the clamping member and restricted by the flanges on the legs of the clamping member.

As shown in FIGS. 9 and 10, each of the two legs 42 of each of the clamping members 40 has two flanges 45 extending from the inside thereof. A clamping slot 46 is formed between the flanges 45 of each of the two legs 42. The magnetic part 36 is fitted into the two clamping slots 46 of the two legs 41 and restricted by the flanges 45.

While we have shown and described the embodiment in accordance with the present invention, it should be clear to those skilled in the art that further embodiments may be made without departing from the scope of the present invention.

What is claimed is:

1. A cordless curtain assembly comprising:

a top rail;

a fabric having a top end connected to the top rail, multiple folding sections formed transversely to the fabric, each folding section having a passage defined therein;

multiple magnetic units respectively received in the passages of the folding sections, each magnetic unit having a carrier, multiple clamping members and multiple magnetic parts, the carrier of each magnetic unit being received in the passage corresponding thereto and having a first sidewall and a second sidewall which is located opposite to the first sidewall, a hollow area defined between the first and second sidewalls, at least two reception areas defined in a top of the carrier and communicating with the hollow area;

each clamping member having a press bar and two legs which respectively extend from an underside of the press bar, the press bar having an identification portion, a receiving space defined between the two legs and the press bar, each leg having a resilient arm extending outward from an outside thereof and toward the press bar, each resilient arm having a distal end, a gap defined between each of the legs and the resilient arm corresponding thereto, and each clamping member having one of the magnetic parts clamped in the receiving space thereof, each of the magnetic parts having a positive-pole face and a negative-pole face which is located opposite to the positive-pole face, the clamping members respectively engaged with the reception areas, the two legs inserted into the reception area and the press bar sealing a top opening of the reception area, the resilient arms of each clamping members being squeezed when passing through the reception area, when the clamping member is engaged with the reception area, the resilient arms expand outward to restrict the clamping member from dropping out from the reception area of the carrier, the fabric being folded by attracting the magnetic units in the folding sections one by one.

2. The cordless curtain assembly as claimed in claim 1, wherein the carriers each are an elongate plastic part, an upright height of the first sidewall is smaller than that of the second sidewall.

3. The cordless curtain assembly as claimed in claim 1, wherein each of the clamping members is a U-shaped plastic member, the width of each of the legs is smaller than the width of the underside of the press bar so as to form two elongate areas formed on two sides of the underside of the press bar relative to the two legs, each of the reception areas has a recessed portion defined in each of the first and second sidewalls of the carrier, a first top support face is defined on the first sidewall by the recessed portion corresponding thereto, and a second top support face is defined on the second sidewall by the recessed portion corresponding thereto, the two legs and the two resilient arms are inserted into the reception area between the first and second sidewalls, the two elongate areas of the press bar are rested on the first and second top support faces when the press bar is engaged with the recessed portions of the first and second sidewalls to seal the top opening of the reception area.

4. The cordless curtain assembly as claimed in claim 1, wherein a width of the gap becomes larger toward the press bar.

5. The cordless curtain assembly as claimed in claim 1, wherein each of the two legs of each of the clamping members has two flanges extending from an inside thereof, a clamping slot is formed between the flanges of each of the two legs, the magnetic part is fitted into the two clamping slots and restricted by the flanges.

* * * * *